US005798601A

United States Patent [19]

Hansen

[11] Patent Number: 5,798,601

[45] Date of Patent: Aug. 25, 1998

[54] ADJUSTABLE RETROFIT IGNITION KIT FOR PORTABLE GAS APPLIANCES

[76] Inventor: James M. Hansen, 2465 Mayfair Ave., White Bear Lake, Minn. 55110

[21] Appl. No.: 656,719

[22] Filed: Jun. 3, 1996

Related U.S. Application Data

[60] Provisional application No. 60/000,009 Jun. 8, 1995.

[51] Int. Cl.[6] ..... H01L 41/113; H01L 41/053

[52] U.S. Cl. ..... 310/339

[58] Field of Search ..... 310/339

[56] References Cited

U.S. PATENT DOCUMENTS

| | | | |
|---|---|---|---|
| 3,425,783 | 2/1969 | Goto | 310/339 |
| 3,428,408 | 2/1969 | Ameyama et al. | 310/339 |
| 3,449,637 | 6/1969 | Suzuki | 310/339 |
| 3,475,654 | 10/1969 | Ochiai et al. | 310/339 |
| 3,486,075 | 12/1969 | Steinke et al. | 310/339 |
| 3,509,388 | 4/1970 | Mifune et al. | 310/339 |
| 3,521,987 | 7/1970 | Goto | 310/339 |
| 3,540,823 | 11/1970 | Ebine et al. | 310/339 |
| 3,819,963 | 6/1974 | Kondo et al. | 310/339 |
| 3,826,952 | 7/1974 | Iwasaki et al. | 310/339 |
| 3,883,288 | 5/1975 | Berlincourt et al. | 431/109 |
| 3,903,436 | 9/1975 | Moriya | 310/339 |
| 3,936,678 | 2/1976 | Mohr | 310/339 |
| 3,949,248 | 4/1976 | Duffner et al. | 310/339 |
| 4,001,615 | 1/1977 | Berlincourt | 310/339 |
| 4,015,152 | 3/1977 | Mohr | 310/339 |
| 4,076,491 | 2/1978 | Mohr | 431/130 |
| 4,248,386 | 2/1981 | Morle | 310/339 |
| 4,485,324 | 11/1984 | Berlincourt et al. | 310/339 |
| 4,691,136 | 9/1987 | Schmidt | 310/339 |
| 4,870,314 | 9/1989 | Hefling | 310/339 |

OTHER PUBLICATIONS

Channel Products, Inc., Gaslighter Aftermarket Kits, Sep. 1992, pp. 25–26.

*Primary Examiner*—Thomas M. Dougherty

[57] ABSTRACT

A piezoelectric ignition kit which includes a piezoelectric ignitor having a distal electrode connected thereto via an insulated conductive lead, and connectors for removably engaging the piezoelectric ignitor and its distal electrode to a gas appliance such as a lantern, heater, or stove. One connector removably engages the piezoelectric ignitor housing to an exterior frame portion of a gas appliance; such a connector has two ends, with each end removably engaged to either the piezoelectric ignitor housing or to the exterior frame portion. The other connector removably engages the distal electrode housing to an interior frame portion of the gas appliance near the burner of the gas appliance; such a connector has two ends, with each end removably engaged to either the distal electrode housing or to the interior frame portion near the burner. The piezoelectric ignitor further includes a heat shrinkable tube tightly wrapped about the contour of the ignitor housing near an actuator of the ignitor to insulate the hand against shocks.

18 Claims, 3 Drawing Sheets

ADJUSTABLE RETROFIT IGNITION KIT FOR PORTABLE GAS APPLIANCES

This application claims the benefit of U.S. Provisional Application No. 60/000,009, filed Jun. 8, 1995.

BACKGROUND OF THE INVENTION

The present invention relates generally to ignition apparatus for gas appliances, particularly to piezoelectric ignition apparatus for gas appliances, and specifically to retrofit piezoelectric ignition apparatus for gas appliances.

Historically, gas appliances, such as portable gas lanterns and catalytic heaters, have been used in both indoor and outdoor conditions wherein they are ignited by bringing a source of combustion (match, gas lighter, flint spark, etc.) in close proximity to the gas/air mixture emanating from the surface of the combustion surface (mantle or grid).

In cases where this ignition is attempted under adverse conditions of rain, cold and/or wind, the ignition of such gas appliances using the ignition systems listed above is very difficult if not impossible. Particularly difficult to light under adverse conditions is a gas mantle lantern.

One critical problem associated with the lighting of gas appliances is the possibility of the accumulation of excessive quantities of gas such as when the appliance fails to light. The consequence may be an explosion in the proximity of the appliance and injury to the person attempting to light the apparatus.

SUMMARY OF THE INVENTION

A general object of the present invention is to provide a unique retrofit ignition kit for a gas appliance.

Another object of the present invention is to provide unique connectors for such a kit. Specifically, the kit includes two connectors. One connector fixes the piezoelectric ignitor housing to the gas appliance; such a connector has two ends, with each end being removably fixed to either the piezoelectric ignitor housing or the gas appliance. The other connector fixes the distal electrode housing to the gas appliance; such a connector also has two ends, with each end being removably fixed to either the distal electrode housing or the gas appliance.

Another object of the present invention is to provide a unique placement for the piezoelectric ignitor housing. Such a placement is on an exterior portion of the gas appliance or on a portion which is readily accessible to the hand. Preferably such an exterior portion is a frame portion of the gas appliance.

Another object of the present invention is to provide a unique placement for the distal electrode housing. Such a placement is on an interior portion of the gas appliance. Preferably such a portion is adjacent to the burner of the appliance.

Another object of the present invention is to provide unique connector ends to the connectors. For example, the provision of a resilient clip on the connector between the distal electrode housing and the gas appliance permits the spark gap from the electrode to the burner to be customized as such permits the position of the electrode to be readily adjusted relative to the burner.

Another object of the present invention is to provide a unique association between the clip and the distal electrode. The clip arms are concentric and define an axis which extends in generally the same direction as the distal electrode, which is elongate. Accordingly, the clip arms can be slid in a linear direction to and away from the burner such that the tip of the electrode may be moved in a linear direction to and away from the burner.

Another object of the present invention is to provide a unique housing for the distal electrode. Such a housing includes a plate for engaging its respective connector. The plate is formed of a metal and is sufficiently thin such that the plate may be bent with a hand tool such as a pliers. The plate is sufficiently thick or sufficiently rigid so as to retain the bent configuration. Bending of the plate changes the angle of the elongate electrode relative to the axis of the clamp and thus permits the kit to be customized for different appliances.

Another object of the present invention is to provide a unique insulator for the piezoelectric ignitor housing. The insulator includes a insulative tube tightly engaging the housing and the contours of the housing. Preferably, the insulative tube is heat shrinkable to provide for an easy step in the manufacture of the kit.

An advantage of the invention is that gas appliances may be easily retrofit so as to include a self-contained ignitor. The kit includes a pair of connectors, with one connector for the piezoelectric ignitor housing and the other connector for the distal electrode unit. Each connector includes two ends, with each end being removable engagable to either the gas appliance or its respective housing. Further, each end is removably fixable to its respective part independently of its other end.

Another advantage is that the kit is customizable. For example, the distal electrode is removably engagable to the gas appliance, thereby permitting the electrode to be located at an optimum position on the appliance.

Another advantage of the invention is that gas appliances may be lit even under adverse weather conditions. The piezoelectric ignitor provides a spark even under such conditions. The placement of the distal electrode in the interior of the device adjacent to the burner maximizes the chances for ignition and minimizes the chances of gas accumulation. The placement of the distal electrode interiorly, such as interiorly of the glass wall of a lantern, shields the spark from wind, rain, and snow.

Another advantage of the invention is that gas appliances may be lit even after the appliance has been roughly handled. The distal electrode is position adjustable. The placement of the distal electrode outside of the burner, instead of inside the burner, permits a relatively easy access thereto for the hand. The placement of the distal electrode inside the glass walls of the lantern surrounding the burner shields the electrode from direct impingement by rain or snow. The placement of the distal electrode on the linear piping leading to the burner permits the spark gap distance to be easily adjusted.

These and further objects and advantages of the present invention will become clearer in light of the following detailed description of the illustrative embodiments of this invention described in connection with the drawings.

BRIEF DESCRIPTION OF THE DRAWINGS

The illustrative embodiments may be best described by reference to the accompanying drawings where.

Figure 1:
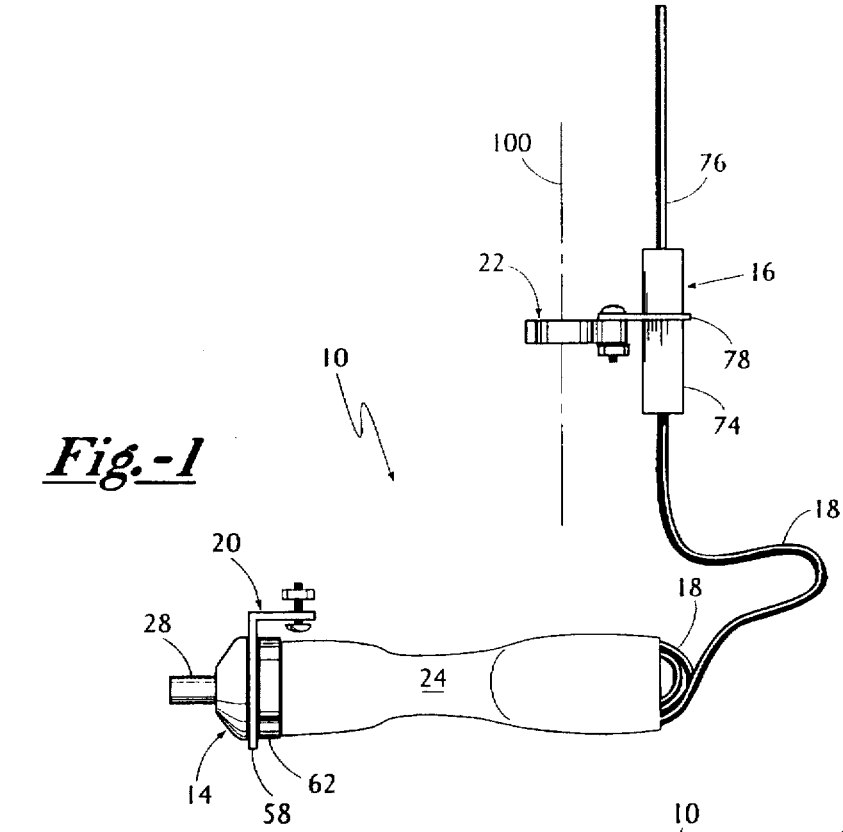
FIG. 1 shows the present adjustable retrofit ignition kit in an assembled form.

All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "inner", "outer", and "axial" and similar terms are used herein, it should be understood that these terms have reference only to the structure shown in the drawings as it would appear to a person viewing the drawings and are utilized only to facilitate describing the preferred embodiments.

DESCRIPTION

Figure 2:
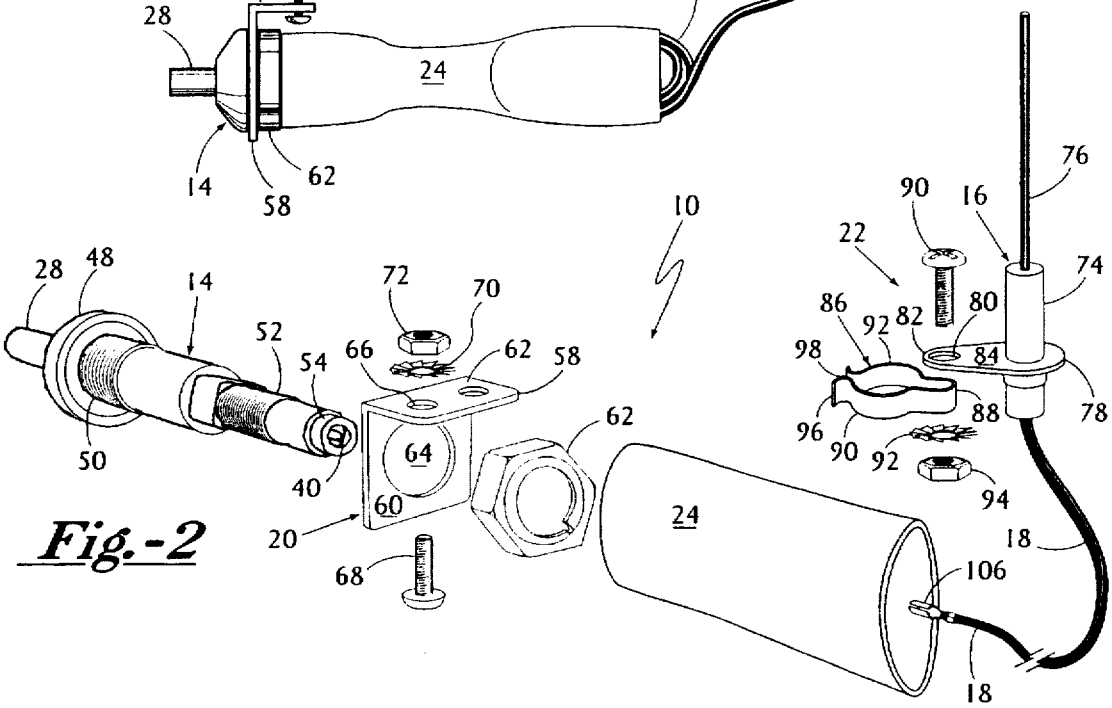
FIG. 2 shows the kit of FIG. 1 in an exploded view.

As shown in FIGS. 1 and 2, the present adjustable retrofit ignition kit is indicated in general by the reference numeral 10. The kit 10 in general includes a piezoelectric ignitor 14, a distal electrode unit 16 electrically connected to the ignitor 14 via an insulated electric lead 18. The kit 10 further includes a first connector 20 for fixing the piezoelectric ignitor 14 to one portion of a gas appliance and a second connector 22 for fixing the distal electrode unit 16 to another portion of a gas appliance. Heat shrinkable tubing 24 is shrinkable about the piezoelectric ignitor 14.

Figure 3:
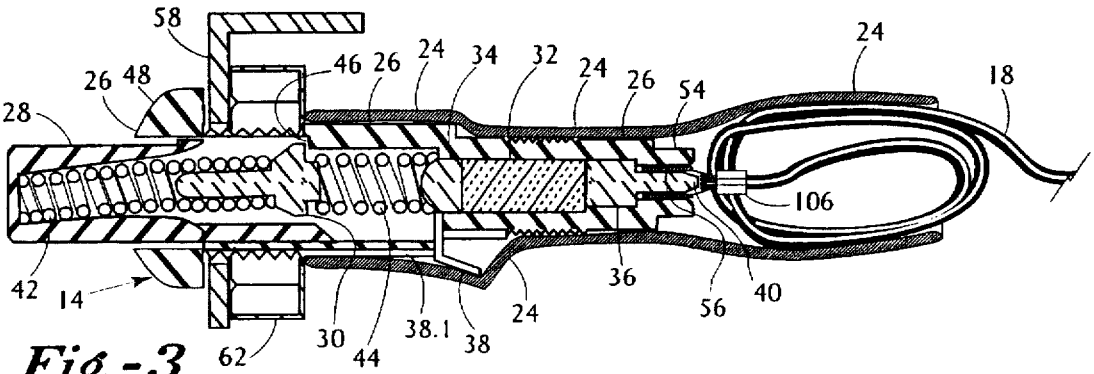
FIG. 3 shows a sectional view of the piezoelectric ignitor of FIGS. 1 and 2.

More specifically, as shown in FIGS. 1, 2 and 3, the piezoelectric ignitor 14 includes an insulative housing 26, an electrically insulative actuator 28, a hammer 30, a piezoelectric crystal 32, a hammer striking metallic conductive end 34 on one side of the piezoelectric crystal 32, and a metallic conductive anvil end 36 on the other side of the piezoelectric crystal 32. A conductive side terminal 38 is electrically connected to the hammer striking end 34 and an end conductive terminal 40 is integral with anvil end 36. An actuating coil spring 42 is fixed between the actuator 28 and hammer 30 and a return spring 44 is disposed between the hammer striking metallic end 34 and the hammer 30. The piezoelectric ignitor 14 is operated by pushing in actuator 28, which will compress actuator spring 44, which in turn will force a head of the hammer 30 onto a ledge 46 formed internally in the housing 26. Further depression of the actuator 28 causes further compression of the actuator spring 44, forcing the head of hammer 30 off of the ledge 46. The actuator spring 44 expands, throwing the hammer 30 against the relatively weak return spring 44 and upon metallic end 34. Such a blow by the hammer 30 causes an elastic wave to pass through piezoelectric element or crystal 32, which generates a relatively high voltage pulse between side and end terminals 38 and 40. The return spring 44 then resets the hammer 30 beyond the ledge 46. As to the piezoelectric ignitor 14, the Berlincourt et al. U.S. Pat. No. 4,485,324 is hereby incorporated by reference in its entirety. The piezoelectric ignitor 14 may be obtained from Channel Products, Inc. of Chesterland, Ohio under part no. 1244-41.

As shown in FIGS. 2 and 3, it should be noted that housing 26 includes an annulus portion 48 adjacent an externally partially threaded portion 50. Further, it should be noted that at the partially threaded portion 50, the diameter of the housing 26 is greater than the diameter of the housing 26 at another externally partially threaded portion 52 which houses the piezoelectric crystal 32. It can further be noted that an integral tip portion 54 of the housing 26 is of yet a smaller diametrical size. Such varying diametrical portions 50, 52, 54 provide a stepped contour to the housing 26. The side terminal 38 shown in FIG. 3, extending from the housing 26 at an angle, provides an irregular contour to the external surface of the ignitor 14. It can further be noted that tip portion 54 includes an inner cylindrical surface 56 spaced from terminal 40. It should be noted that some piezoelectric ignitors include side terminals 38 which are flush with their respective housings and do not extend out like terminal 38.

As shown in FIGS. 1 and 2, the first connector 20 is removably engaged to the annular portion 48 and threaded portion 50 of the ignitor 14. The first connector 20 includes an L-shaped or right angled bracket 58. The L-shaped bracket 58 includes a first plate portion 60 integrally formed with a second plate portion 62. The first plate portion 60 forms an aperture 64 of a diameter slightly greater than threaded portion 50 such that the bracket 58 can be slid onto housing 26 and against annular portion 48. The bracket 58 is removably fixed in such a position by a nut 62 engaging threaded portion 50 and pinching the bracket 58 against the annular portion 48. The second plate portion 62 includes a pair of through holes 66. Each of the holes 66 permits the bracket 58 to be affixed, such as to a portable gas appliance, via one or more threaded pin connectors or screws 68, locking washers 70, and nuts 72. The inclusion of two or more holes 66 facilitates mounting of bracket in a variety of positions, such as to suit right-handed or left-handed people. It can thus be appreciated that the connector 20 includes a pair of ends, each of which is removably engagable to either the ignitor 14 or to another apparatus such as a portable gas appliance.

As shown in FIGS. 1 and 2, the distal electrode unit 16 includes an electrically insulative generally cylindrical housing 74 which has fixed thereto an elongate conductive bendable electrode or terminal 76. The elongate electrode 76 is electrically connected within the housing 74 to the electrically insulative conductive lead 18 and thus is electrically connected to the end terminal 40 of the piezoelectric ignitor 14. Fixed to the housing 74 is a metal plate 78 extending from the housing 74 at a right angle. The metal plate 78 includes an aperture 80 formed at a distal end 82. The metal plate 78 is bendable at a portion 84 between the distal end 82 and housing 74 to permit the distal end 82 to lie in a plane disposed at an angle to the unbent portion of metal plate 78. Accordingly, the metal plate 78 is formed of a material which is bendable by a hand tool such as a pliers and retains its bent configuration after being bent.

Figure 4:
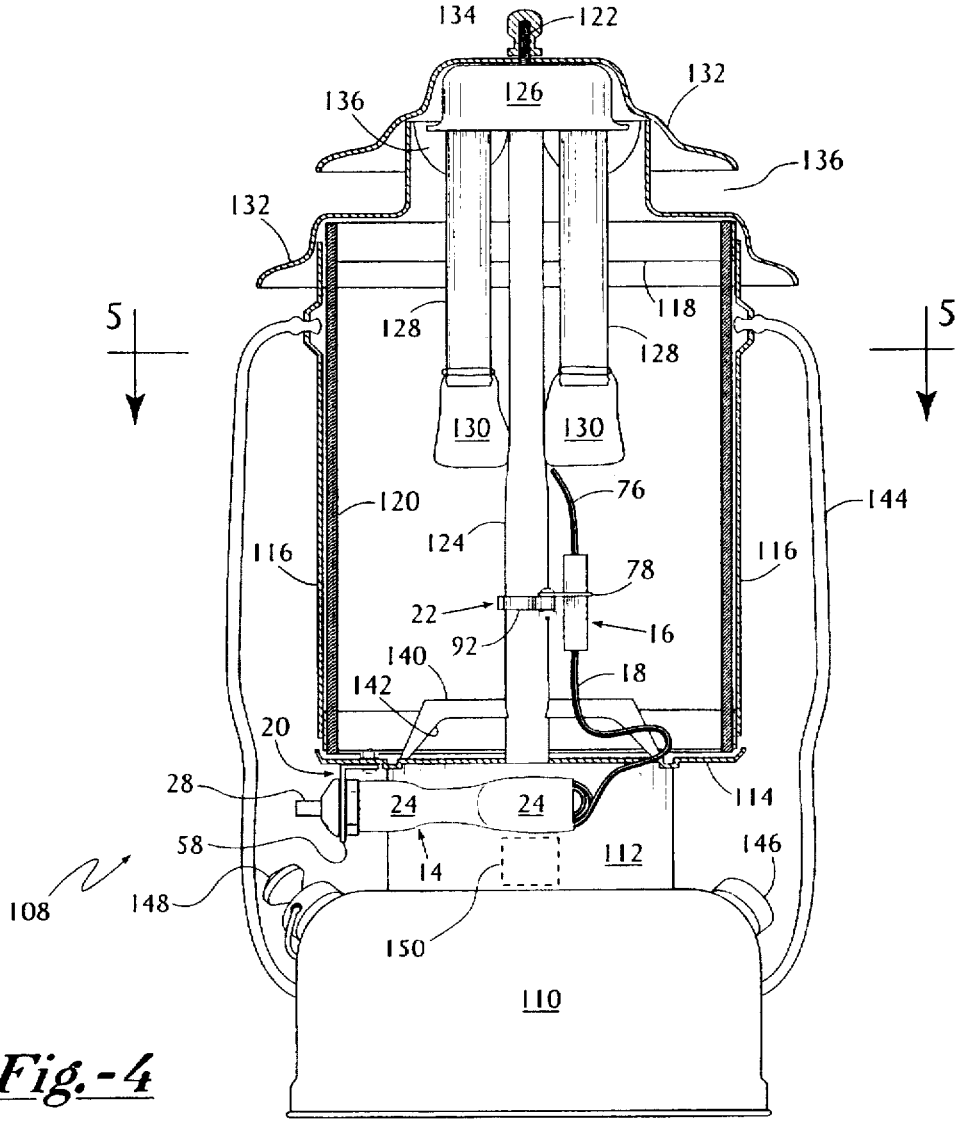
FIG. 4 shows the most preferred combination of the present invention, with the ignition kit of FIG. 1 engaged to a portable gas lantern.

The connector 22 includes a resilient clip or clamp 86 with a first end 88 which is removably engagable to the housing 74 via a threaded pin connector or screw 90, a locking washer 92, and a nut 94. End 88 is pinched between the head of the pin connector 90 and the metal plate 78. End 88 is integral with a second end 90 of the connector 22. Second end 90 includes a pair of resilient generally semicircular arm portions 92 for clipping or clamping onto an apparatus such as a portable gas appliance. Each of the arm portions 92 includes a flared end 96. The flared ends 96 extend away from each other to form an opening or receptor 98 leading into an interior clamping portion of the connector 22. It should be noted that the semi-circular arm portions 92 generally define arcs concentric with each other so as to define an axis 100. The axis 100 is generally parallel to the elongate electrode 76. As shown in FIG. 4, a distal portion of the elongate electrode 76 may be bent so as to bring the tip of the electrode 76 closer to a metal surface in the gas appliance or closer to the portion of the gas appliance from which the gas flame emanates.

The electrically insulative housing or layer 26 is complemented by the other insulative layer or tube 24. Layer 24 is preferably formed of heat-shrinkable material shaped in the form of a tube. Tubular layer 24 is shown in its original, nonshrunk form in the exploded view of FIG. 2 and is shown in its shrunk form in FIGS. 1 and 3. The heat required to shrink such material is of an intensity and temperature no greater than that which is hot to the touch, such as the heat produced by hand-held hair dryer or intensity of the heat produced by a cigarette lighter at a distance, in centimeters, beyond the tip of the flame. The tubular layer 24 is preferably formed of a flexible polyolefin tubing available from Minnesota Mining and Manufacturing (3M) of Maplewood, Minnesota under product no. FP-750-BK-25. It should be noted that the tubular layer 24 shrinks at least about the stepped housing portions 50 and 52 and, if the piezoelectric ignitor 14 includes a projecting terminal 38, the tubular layer 24 shrinks about such. The tubular layer 24 may shrink to a smaller diametrical size, such as to and about the end stepped portion 56, or may be shrunk around a wound coil of lead 18 as shown in FIG. 3.

It should further be noted that, in assembly, shrinking of the tubular layer 24 about housing portion 50 and against nut 62 acts as a lock against the nut 62, as shown in FIGS. 1 and 3. However, the tubular layer 24 may be twisted off, much like a nut. Such a twisting is facilitated by partially threaded portions 50 and 52.

It should further be noted that the length of the tubular layer 24 is sufficient to cover both terminals 38 and 40 so as to minimize the chances of shocks to the hand. The relatively great length of the tubular layer 24 may be seen in FIG. 1, where an opened end of the tubular layer 24 engages a coiled portion of the conductive lead 18. Such a pocket is formed by selectively applying heat to the tubular layer 24. Heat may be applied only to the portion of the tubular layer 24 which is desired to fit tightly about the housing portions 50 and 52. Heat may be applied for a lesser amount of time to the portion of the tube 24 encapsulating the lead coil. Conductive lead 18 includes an end 106 which is removably engagable with end terminal 40.

The piezoelectric ignitor kit 10 may be removably fixed to a gas appliance such as a portable gas lantern 108, as shown in FIG. 4. The gas lantern 108 includes a fuel tank 110 and a frame base portion 112 extending centrally from an upper end of the tank 110. A disk like base or frame plate 114 is mounted on the base portion 112. A set of four frame arms 116 are rigidly fixed to the base plate 114 and extend upwardly therefrom to be rigidly affixed to an annular frame rim 118. The arms 116 are spaced 90° apart such that the arms 116 in combination with the plate 114 and annular rim 118 hold therewithin a glass cylinder 120. Frame components of the lantern 108 further include a central rod 122 fixed at least to plate 114 and frame portion 112 and a metal conduit 124 extending at least from frame portion 112 to be joined to an upper portion of central rod 122. Metal conduit 124 conveys fuel from at least the frame portion 112 to a pan or receptacle shaped fuel collection portion 126, where the fuel is distributed to downwardly extending conduits 128 to which mantles 130 are sewn or clipped. Mantels 130 define burners of the appliance 108, i.e., the portion of the appliance at which the fuel is combusted. A double crowned cover 132, having a centrally located aperture through which central rod 122 extends, keeps rain out of the lantern and is fixed in place on the annular rim 118 and fuel collection portion 126 via a nut 134 screwed onto the threaded central rod 122 such that the cover 122 is pinched between the pan portion 126 and the nut 134. Air is permitted into the interior of the glass cylinder 120 via openings 136 between the crowns of the cover 132 and U-shaped openings 138 in the plate 114. A heat shield 140 having legs 142 is spaced from the plate 114. A handle 144 is pivotally fixed to opposite arms 116. Fuel tank 110 includes a cap 146 for permitting the tank to be filled with fuel, typically a liquid fuel. Fuel tank 110 further includes a pump 148 for pressurizing the tank 110. A valve 150 disposed in portion 112 and operated by valve control 152 controls the flow of fuel to the mantels 130. The preferred lantern is the Coleman ® CL2 model 288 available from The Coleman Co. Inc. of Wichita, Kans.

In assembly, the bracket 58 is slid onto the partially threaded portion 50 and against the annular portion 48 of the body 26. The nut 62 is then threaded onto the external threads of portion 50 so as to pinch the bracket 58 against the annular portion 48. Then the heat shrinkable tube 24 is slid onto and over the body portions 50, 52 and 54 and against the nut 62. The length of the tube 24 is sufficient so as to extend beyond the end terminal 40. Then the excess lead 18 may be wound in a coil and a portion of the coil may be placed within the tube 24. Then heat, such as from a cigarette lighter or portable hair dryer, may be applied to the tube 24 so as to shrink the tube 24 tightly around the body portions 50, 52, 54, side terminal 38, and tightly against the nut 62. Less heat may be applied to the portion of the tube 24 having the lead coil. If desired, as shown in FIG. 3, the coil 18 may be excluded from the tube 24. Further, it should be noted that the side terminal shown in FIG. 3 is different from the side terminal of the ignitor of FIG. 2, the side terminal of which may run flush with the body portions 50 and 52. If the tube 24 was in proper position when shrunk, the tube 24 may be twisted off much in the nature of a nut, since when shrunk the tube 24 at least partially engages the external threads of body portions 50 and 52.

After installation of the tube 24, the ignitor 14 may be mounted on the lantern 108. First, the nut 134 is screwed off and the double crowned cover 132 is removed. Such permits removal of the glass cylinder 120. Access is thus provided to the support plate 114. Then a preexisting hole may be located in the support plate 114 of the lantern 108. If such a hole does not exist, a hole may be easily punched or drilled in the plate 114. Then the bracket 58 is connected to the plate 114 via the screw 68, lock washer 70 and nut 72. The bracket 58 is electrically connected to the side terminal 38 through side terminal portion 38.1, which is electrically connected to nut 62, which in turn is electrically connected to bracket 58, which thus serves as the ground for the ignitor 14 when it is connected to an apparatus. The lead 18 is then slightly uncoiled, whether or not inside of the shrunk tube 24, and positioned within one of the U-shaped openings 138 in the support plate 114. Then, with the clip 86 already having been fixed to the plate 78 of the distal electrode unit 16, the clip 86 is snapped onto the conduit 124 and the distal electrode 76 may be slightly bent to be adjacent a metal portion, such as the metal conduit 124, to permit a spark to jump from the distal tip of the electrode 76 to the conduit 124 in an area adjacent to one of the mantels 130. Then the glass cylinder 120 is placed back onto the plate 114 and within the arms 116 and rim 118. Then the double crowned cover 132 is placed on the mantel conduit base 126 and the nut 134 is tightened on the rod 122. It should be noted that the above assembly procedure is reversible.

It should be noted that the steps for the above installation of connector 20 may change depending upon the appliance to which it is being connected. For example, the bracket 58 may first be affixed to the appliance. Hence, the head of connector pin 68 may be accessed without the ignitor 14 being in the way. Further, the interior of the appliance may not be accessible such that washers 72 may not be usable; in such a case, pin connectors 68 or similar pin connectors may be used. After the bracket 58 is engaged to the appliance, the ignitor 14 itself may be affixed to the bracket. It can thus be seen that the connector 20 has two ends, each of which is removable engagable relative to the appliance or ignitor 14. Likewise, the steps for installation of connector 22 may change depending upon the appliance. For example, the clip 86 may first be removably fixed to the appliance, and thereafter the distal electrode unit 16 may be affixed to the clip. Accordingly, it can be seen that the connector 22 has two ends, each of which is removably engagable relative to the appliance or ignitor.

Figure 5:
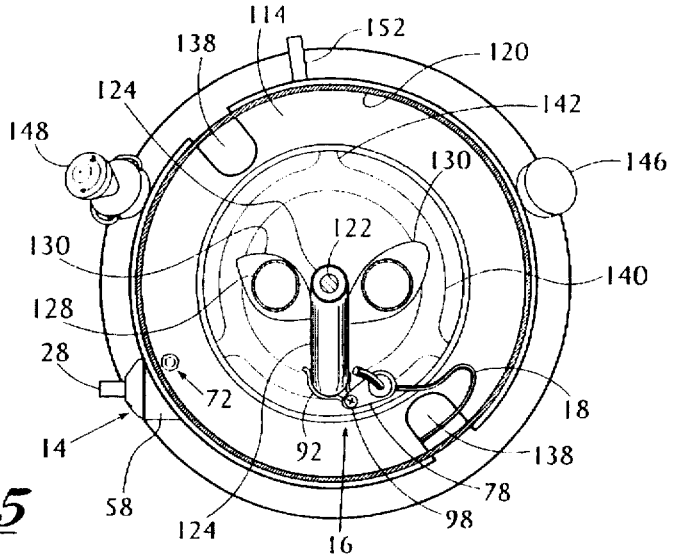
FIG. 5 is a section view at lines 5—5 of FIG. 4.

It can be appreciated that the ignitor 14 is tucked in an out of the way position between the tank 110 and the support plate 114. As can be seen in FIG. 5, only the actuator 28, annulus 48, and a portion of the bracket 58 extend beyond the plate 114.

It can be appreciated that one hand may be used to push the actuator 28 and the other hand may be used to manipulate the control 152 for the valve 150.

It can be appreciated that the electrode unit 16 is thus isolated from the wind and rain and snow by the glass cylinder 120, the plate 114, and the double crowned cover 132.

It can further be appreciated that the ignition kit is environmentally safe; the ignition kit 10 requires no matches. Further, since it requires no matches, less trash is introduced into the environment.

Figure 6:
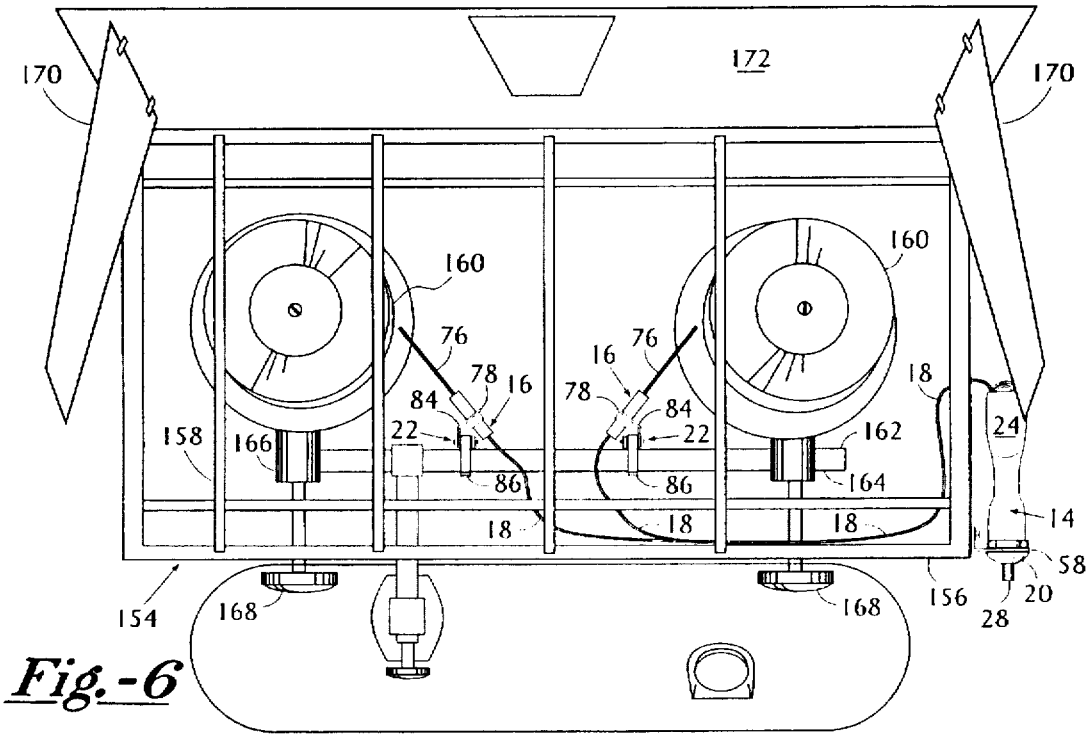
FIG. 6 is a schematic view of a preferred combination of the present invention, with the ignition kit of claim 1 engaged to a portable gas stove.

Another portable gas appliance, a portable gas stove 154 is shown in FIG. 6. It includes a housing 156 in which a grill 158 and burners 160 are fixed. The gas stove may have external fuel source or tank in communication with a conduit 164 leading to the burners 160. Fuel flow to each of the burners 160 is controlled by a valve 166 having a control 168 manipulated by the hand. The stove 154 may further include foldable, wind blocking side panels 170 and a foldable, wind blocking rear panel 172, all of which may be foldable onto the grill 158 to render the stove 154 compact. Clips 86 may be snapped into place on conduit 164 and bracket 58 may be fixed to the housing 156. Leads 18 from respective distal electrode units 16 may be spliced together such that one ignitor 14 may supply a spark at the same time to each of the burners 160. Distal electrode plate 78 may be bent with a hand tool such as a pliers to position the elongate distal electrode 76 at an oblique angle relative to the axis 100 of the clip 86.

Figure 7:
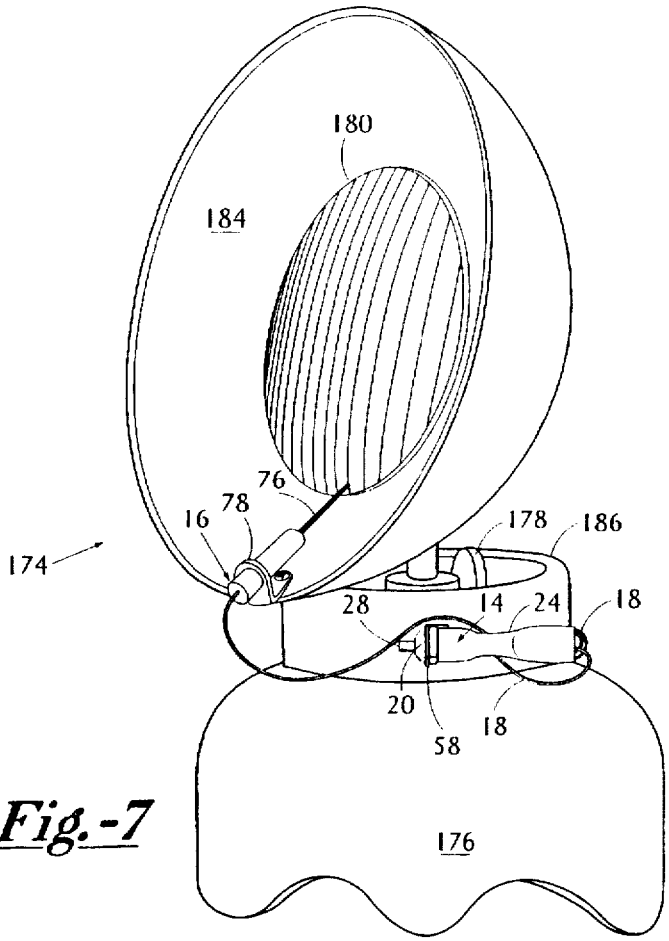
FIG. 7 is a schematic view of a preferred combination of the present invention, with the ignition kit of claim 1 engaged to a portable gas heater.

Another gas appliance, a portable gas heater 174, is shown in FIG. 7. The heater 174 includes a fuel tank 176, a valve 178 for controlling flow of fuel from the tank 176 to a heating element or burner 180. Heating element 180 is recessed in a parabolic like, heat radiating member 184. Element 180 and member 184 may be supported by the conduit extending upwardly from valve 178. A collar or frame portion 186 protects the valve 178 from being accidentally turned on or breaking off if the heater 174 is turned over. The collar 186 is fixed to an upper end of the tank 176. The distal electrode unit 16 is mounted on the inner surface of parabolic member 184 via the plate 78 being bent at portion 84 and being directly fixed to such inner surface via a pin connector such as pin connector 90. The ignitor 14 is fixed via bracket 58 to the collar 186.

It should be noted that the ignitor of the present invention is preferably a flint ignitor or an ignitor having batteries therein for generating a spark. More preferably, the ignitor of the present invention is a piezoelectric ignitor.

Thus since the invention disclosed herein may be embodied in other specific forms without departing from the spirit or general characteristics thereof some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A retrofit piezoelectric ignition kit for an apparatus having a burner, a first frame portion readily accessible to the hand, and a second portion adjacent to the burner, with the retrofit piezoelectric ignition kit comprising:

a) a housing having an exterior with a threaded portion and an annular flange extending about the exterior adjacent the exterior threaded portion;

b) a nut threadingly engagable with the exterior threaded portion of the housing, c) a piezoelectric crystal in the housing;

d) a hammer in the housing and strikeable against the piezoelectric crystal for generating a voltage;

e) first and second conductors between the piezoelectric crystal and a portion of the exterior for conducting voltage from the piezoelectric crystal out of the housing;

f) a hand-operated actuator on the housing and being engaged to the hammer to operate the hammer to produce the voltage;

g) an electrically insulative tube about at least a section of the exterior to insulate the hand against shocks produced by the voltage, with the electrically insulative tube tightly engaging the exterior section of the housing such that the tube follows the contour of the housing, with the exterior section of the housing having a portion adjacent to the actuator to insulate the hand against shocks, with the electrically insulative tube being formed of a heat-shrinkable material, with the heat required to shrink such material being of an intensity and temperature no greater than that which is hot to the touch;

h) an electrode unit having an electrically insulative body and an electrode extending therefrom, with the electrode having a distal tip from which a spark may emanate;

i) an insulated conductive lead between the electrode unit and the first conductor of the piezoelectric ignitor to electrically connect the piezoelectric ignitor and the electrode such that a spark may emanate from the distal tip of the electrode;

j) a first structural member electrically connected to the second conductor such that the first structural member is a ground for the piezoelectric ignitor, with the first structural member comprising:

i) a first end comprising a first plate portion having a first aperture for receiving the housing of the piezoelectric ignitor, with the first aperture being defined by an interior edge threadable onto the threaded portion of the housing, with the first plate portion being confrontable against the flange of the housing and being removably fixed in such a position via the nut being threaded onto the threaded portion of the housing; and ii) a second end comprising a second plate portion, with the plate portions being integrally and rigidly engaged with each other at an angle, and with the second plate portion being removably fixed to the first frame portion of the apparatus such that the piezoelectric ignitor is removably fixable to the first frame portion of the apparatus; and k) a second structural member comprising:

i) a first end removably engagable to the electrode unit; and ii) a second end removably engagable to the second portion of the apparatus such that the electrode unit is removably engagable to the second portion adjacent the burner such that the distal tip of the electrode may be fixed adjacent the burner and at a customized distance from the burner, with the second end of the second structural member comprising a resilient clamp having a pair of arms resiliently biased toward each other such that the arms pinch the second portion therebetween, with each of the arms comprising a pinching portion which engages the second portion and a flared distal end portion integral with and extending away from the pinched portion to define an opening into the clamp for readily accepting the second portion and such that the arms extend resiliently apart when the clamp is pushed onto the second portion.

2. A retrofit ignition kit for an apparatus having a burner, a first frame portion readily accessible to the hand, and a second portion adjacent to the burner, with the retrofit ignition kit comprising:

a) an ignitor comprising:

i) a housing;

ii) a hand-operated actuator on the housing for actuating the ignitor; and iii) a spark emanating unit comprising an end from which a spark may emanate;

b) a first structural member comprising:

i) a first end engaged with the housing of the ignitor; and ii) a second end integral with the first end of the first structural member and being removably engagable to the first frame portion of the apparatus such that the ignitor is removably fixable to the first frame portion of the apparatus; and c) a second structural member comprising:

i) a first end engaged with the spark emanating unit; and ii) a second end integral with the first end of the second structural member and being removably engagable to the second portion of the apparatus such that the spark emanating unit is removably engagable to the second portion adjacent the burner and such that the end of the spark emanating unit may be fixed adjacent the burner and at a customized distance from the burner;

d) wherein the ignitor further comprises a piezoelectric crystal in the housing, a hammer in the housing and strikable against the piezoelectric crystal for generating a voltage, a conductor between the piezoelectric crystal and a portion of the exterior for conducting voltage from the piezoelectric crystal out of the housing, with the handoperated actuator being engaged to the hammer to operate the hammer to produce the voltage; and wherein the spark emanating unit further comprises an electrode unit having an electrically insulative body and an electrode extending therefrom, with the electrode having a distal tip from which a spark may emanate; and further comprising a conductive lead between the electrode unit and the conductor of the piezoelectric ignitor to electrically connect the piezoelectric ignitor and the electrode such that a spark may be generated at the distal tip of the electrode.

3. The retrofit ignition kit of claim 2 wherein the first end of the first structural member is removably engagable with the housing of the ignitor, and with the first and second ends of the first structural member being removably engagable independently of the other.

4. The retrofit ignition kit of claim 2 wherein the first end of the second structural member is removably engagable with the spark emanating unit, and with the first and second ends of the second structural member being removably engagable independently of the other.

5. The retrofit ignition kit of claim 2 wherein the ignitor further comprises a voltage producing ignitor and wherein the first structural member is electrically connected to the ignitor such that the first structural member serves as an electrical ground for the ignitor.

6. The retrofit ignition kit of claim 2 wherein the second end of the second structural member comprises a resilient clip fixable to the second portion of the apparatus, with the resilient clip having a pair of arms resiliently biased toward each other such that the arms pinch the second portion therebetween.

7. The retrofit ignition kit of claim 6 wherein each of the arms comprises a pinching portion which engages the second portion and a flared distal end portion integral with and extending away from the pinched portion to define an opening into the clip to readily accept the second portion and such that the arms extend resiliently apart when the clip is pushed onto the second portion.

8. The retrofit ignition kit of claim 6 wherein the electrode is elongate and wherein each of the arms comprises a portion defining an arc, with each of the arm portions being concentric and defining an axis, with the clip being fixed to the electrode unit such that both the axis of the clip and elongate electrode extend in the same general direction, whereby linear adjustment of the clip along the axis is associated with linear adjustment of the distal tip of the elongate electrode to and away from the burner of the apparatus.

9. The retrofit ignition kit of claim 6 wherein the electrode is elongate, wherein each of the arms comprises a portion defining an arc, with each of the arm portions being concentric and defining an axis, and wherein the electrode unit further comprises a plate engaged to and extending from the body of the electrode unit, with the plate having a thickness sufficiently thin to permit the plate to be bent with a hand tool such as a pliers into a bent configuration having a bent portion, with the plate being sufficiently rigid to permit the plate to retain the bent configuration, and with the first end of the second structural end of the second structural member being removably engagable with the bent portion such that the elongate electrode may be fixed at a customized angle relative to the axis of the clamp.

10. The retrofit ignition kit of claim 2 wherein the housing of the ignitor comprises an exterior threaded portion and an annular flange extending about the housing adjacent the exterior threaded portion, and wherein the kit further comprises a nut threadingly engaging the exterior threaded portion of the housing, with the nut pinching the first end of the first structural member against the flange such that the ignitor is removably engagable to the first frame portion of the apparatus.

11. The retrofit ignition kit of claim 2 wherein the first end of the first structural member comprises a first plate portion and wherein the second end of the first structural member comprises a second plate portion, with the first plate portion having an aperture defined by an interior edge which engages the housing of the ignitor, and with the retrofit ignition kit further comprising a pin connector, with the second plate portion having an aperture for engaging the pin connector, and with one of the second plate portion and pin connector cooperating to engage the second plate portion with the second portion.

12. The retrofit ignition kit of claim 2 wherein the ignitor is a voltage producing ignitor and further comprising an electrically insulative tube about at least a section of the exterior of the ignitor to insulate the hand, with the insulative tube tightly engaging the exterior section of the housing such that the tube follows the contour of the housing.

13. The retrofit ignition kit of claim 12 wherein the electrically insulative tube is formed of a heat-shrinkable material, with the heat required to shrink such material being of an intensity and temperature no greater than that which is hot to the touch.

14. The retrofit ignition kit of claim 2 in combination with the apparatus, wherein the first frame portion of the apparatus includes an exterior frame portion and wherein the second portion of the apparatus includes an interior portion of the apparatus.

15. A hand operated piezoelectric ignitor comprising:

a) a housing having an exterior and a contour to the exterior;

b) a piezoelectric crystal in the housing;

c) a hammer in the housing and strikeable against the piezoelectric crystal for generating a voltage;

d) a first electrode at least partially in the housing and being electrically connected to the piezoelectric crystal for generating a spark in response to the voltage;

e) a hand-operated actuator on the housing and being engaged to the hammer to operate the hammer to produce the voltage;

f) an electrically insulative tube about at least a section of the exterior to insulate the hand against shocks produced by the voltage, with the electrically insulative tube tightly engaging the exterior section of the housing such that the tube follows the contour of the housing;

g) and further comprising another electrode, with one electrode being disposed on the side of the housing and with the other electrode being disposed on an end portion of the housing, and with the tube covering both electrodes and extending in an axial direction beyond the electrode on the end portion of the housing.

16. The hand-operated piezoelectric crystal ignitor of claim 15 wherein the electrically insulative tube is formed of a heat-shrinkable material, with the heat required to shrink such material being of an intensity and temperature no greater than that which is hot to the touch.

17. The hand-operated piezoelectric ignitor of claim 15 in combination with a fluid fuel apparatus selected from the group consisting of lanterns, heaters, and stoves, with the apparatus having a burner, and with the piezoelectric ignitor engaged to the apparatus, and with the piezoelectric ignitor further comprising a distal electrode and a lead between the distal electrode and the first electrode, with the distal electrode of the piezoelectric ignitor being adjacent to the burner.

18. A hand operated piezoelectric ignitor in combination with a fluid fuel lantern, the fluid fuel lantern having a frame, a fuel tank on the frame, a burner on the frame, piping from the fuel tank to the burner, and a hand control for regulating fuel flow from the tank to the burner, comprising:

a) a housing having an exterior and a contour to the exterior;

b) a piezoelectric crystal in the housing;

c) a hammer in the housing and strikeable against the piezoelectric crystal for generating a voltage;

d) a first electrode at least partially in the housing and being electrically connected to the piezoelectric crystal for generating a spark in response to the voltage;

e) a hand-operated actuator on the housing and being engaged to the hammer to operate the hammer to produce the voltage;

f) an electrically insulative tube about at least a section of the exterior to insulate the hand against shocks produced by the voltage, with the electrically insulative tube tightly engaging the exterior section of the housing such that the tube follows the contour of the housing; and g) with the hand-operated piezoelectric crystal ignitor further comprising a distal electrode unit electrically connected to the first electrode and having an electrode tip, with the distal electrode unit being removably engagable with the piping such that the distance between the electrode tip and the burner is adjustable, and with the housing of the piezoelectric ignitor being removably fixed to a portion of the frame readily accessible to the hand such that one hand may operate the hand control and the other hand may operate the actuator to generate the spark.

* * * * *